US006573657B2

(12) United States Patent
Mehr et al.

(10) Patent No.: US 6,573,657 B2
(45) Date of Patent: Jun. 3, 2003

(54) SHORT-ARC HIGH-PRESSURE DISCHARGE LAMP FOR DIGITAL PROJECTION TECHNOLOGIES

(75) Inventors: Thomas Mehr, Dollenstein (DE); Ralf Seedorf, Berlin (DE)

(73) Assignee: Patent-Treuhand-Gesellschaft fur elektrische Gluhlampen mbH, Munich (DE)

( * ) Notice: Subject to any disclaimer, the term of this patent is extended or adjusted under 35 U.S.C. 154(b) by 12 days.

(21) Appl. No.: 10/013,503

(22) Filed: Dec. 13, 2001

(65) Prior Publication Data

US 2002/0074943 A1 Jun. 20, 2002

(30) Foreign Application Priority Data

Dec. 20, 2000 (DE) ..... 100 63 938

(51) Int. Cl.[7] ..... H01J 61/06
(52) U.S. Cl. ..... 313/631; 313/491; 313/620
(58) Field of Search ..... 313/491, 620, 313/621, 631

(56) References Cited

FOREIGN PATENT DOCUMENTS

| | | | |
|---|---|---|---|
| DE | 2122122 | | 11/1971 |
| DE | 3716485 | C1 | 11/1988 |
| EP | 0 704 881 | A2 | 4/1996 |
| EP | 0 901 151 | A1 | 3/1999 |
| EP | 0 973 187 | A1 | 1/2000 |

OTHER PUBLICATIONS

EPO, Abstract of Japan, Appln # 06025516, Pub Date Sep. 5, 1995.

EPO, Abstract of Japan, Appln # 073117709, Pub Date Apr. 8, 1997.

EPO, Abstract of Japan, Appln # 07253283, Pub Date Apr. 8, 1997.

EPO, Abstract of Japan, Appln # 10121472, Pub Date Nov. 16, 1999.

EPO, Abstract of Japan, Appln# 08259986, Pub Date Jun. 10, 1997.

*Primary Examiner*—Vip Patel
(74) *Attorney, Agent, or Firm*—William E. Meyer

(57) ABSTRACT

In a short-arc high-pressure discharge lamp (1) with a xenon fill for digital projection purposes, the separation L in mm of the two mutually facing end sections (6*a*, 8*c*) of the cathode (6) and the anode (8) when the lamp is hot is given by the relationship $0.8 \times P \leqq L \leqq 1 \times P + 1$, where P is the lamp power in kW. Further, the diameter D of the circular-cylindrical middle section (8*a*) of the anode (8) in mm obeys the relationship $D \geqq 2.1 \times L + 10$.

6 Claims, 2 Drawing Sheets

SHORT-ARC HIGH-PRESSURE DISCHARGE LAMP FOR DIGITAL PROJECTION TECHNOLOGIES

TECHNICAL FIELD

The invention is based on a short-arc high-pressure discharge lamp according to the preamble of claim 1. It involves, in particular, a short-arc high-pressure discharge lamp with a xenon fill, as is used in cinema projection.

PRIOR ART

The known xenon short-arc lamps for projection purposes were optimized for arc lengths and electrode geometries which are ideal for 35 to 70 mm film projection. The picture diagonals of these films lie in the range of between 28 and 60 mm. If such standard lamps are used in modern digital projection systems with DMD, DLP, LCD and D-ILA technology, then owing to the mismatch between the lamp and the optical system, a great deal of light is lost and does not reach the screen. This lost light is converted into heat in the projector and leads to additional problems. To date, it has been possible to resolve this problem only by a higher lamp power, which then requires greater outlay on cooling, an optimized mirror design, which places great demands on the accuracy and the simulation tasks, and additional double mirrors, which in turn entail cooling problems in the reflector volume.

DESCRIPTION OF THE INVENTION

It is an object of the present invention to provide a short-arc lamp with a xenon fill according to the preamble of claim 1, which permits optimum focusing of the light onto small cross sections of between 10 and 25 mm, corresponding to the diagonals of the integrators that are used in digital projection technologies (DMD, DLP, LCD and D-ILA).

This object is achieved by the characterizing features of claim 1. Particularly advantageous configurations can be found in the dependent claims. Further, the lamp is advantageously operated with a lamp current which satisfies the features of claim 6.

By setting the separation L in mm of the two mutually facing end sections of the anode and the cathode when the lamp is hot, according to the relationship $0.8\times P \leqq L \leqq 1\times P+1$, where P is the lamp power in kW, optimum illumination of the picture window is achieved. With longer arc lengths, the efficiency of the system, i.e. the ratio of the output light flux to the incoming power, is significantly degraded. If the anode-cathode separation is shorter than in the relationship, then the life of the lamp is unacceptably reduced.

The stronger heating of the front surface of the anode (anode plateau) for shorter arcs also requires adaptation of the anode geometry. For instance, the diameter D of the anode in mm must satisfy the relationship $D \geqq 2.1\times L+10$, where L is the separation of the mutually facing end sections of the anode and the cathode in mm when the lamp is hot.

Advantageously, for optimum luminous efficiency with a long life, the frustoconical end section of the anode, which faces the cathode, should have a plateau AP with a diameter in mm that satisfies the relationship $1.8\times L-1 \leqq AP \leqq 1.8\times L+1$, where L is again the separation of the mutually facing ends of the anode and the cathode in mm when hot. When the anode plateau diameter falls below this, strong erosion (cratering) on the anode plateau leads to a shorter life. In the case of an anode plateau that is larger than specified by the relationship, the system efficiency is degraded because of shadowing.

For optimum distribution of the light density throughout the life, the tip of the conical end section of the cathode is further advantageously designed as a hemisphere, wherein the radius R of the hemisphere in mm satisfies the relationship $0.12\times P+0.1 \leqq R \leqq 0.12\times P+0.5$, with P being the lamp power in kW. Larger diameters of the hemisphere result in a lower light density, and smaller diameters lead to enhanced cathode burn-off.

Advantageously, the conical end section of the cathode has a vertex angle $\alpha$ of between 36 and 44°. Further, the frustoconical end section of the anode has, for optimum operation, a vertex angle $\beta$ of between 90 and 105°. More pointed geometries lead to stronger burn-off of the electrode tips, while blunter geometries cause a high degree of shadowing in the projector.

For optimum operation with a sufficiently high efficiency (lumen/W), and an acceptable decrease in the light flux over the life of the lamp, the lamp should be operated, at a rated power P of between 0 and 5.5 kW, with a lamp current I in A of the relationship $22\times P+38 \leqq I \leqq 22\times P+65$ and, at a rated power P of between 5.5 and 12 kW, with a lamp current I in A of the relationship $10\times P+100 \leqq I \leqq 22\times P+65$. While weaker currents reduce the luminous efficiency in the system, the cathode erosion increases with stronger currents and the maintenance falls below acceptable values.

DESCRIPTION OF THE DRAWINGS

With the following figures, the invention will be explained in more detail in relation to an exemplary embodiment:

FIG. 1 represents a short-arc high-pressure discharge lamp 1 according to the invention with a Xe fill. The lamp 1, with a power consumption of 3000 W, consists of a rotationally symmetric light bulb 2 made of quartz glass, the two ends of which are each fitted with a lamp shaft 3, 4, also made of quartz glass. A tungsten electrode rod 5, the inner end of which supports a cathode 6, is fused hermetically into one of the shafts, the shaft 3. A tungsten electrode rod 7, the inner end of which has an anode 8 fastened to it, is likewise fused hermetically into the other lamp shaft 4. Base systems 9, 10 for support and electrical connection are fitted to the outer ends of the electrode shafts 3, 4.

Figure 1:
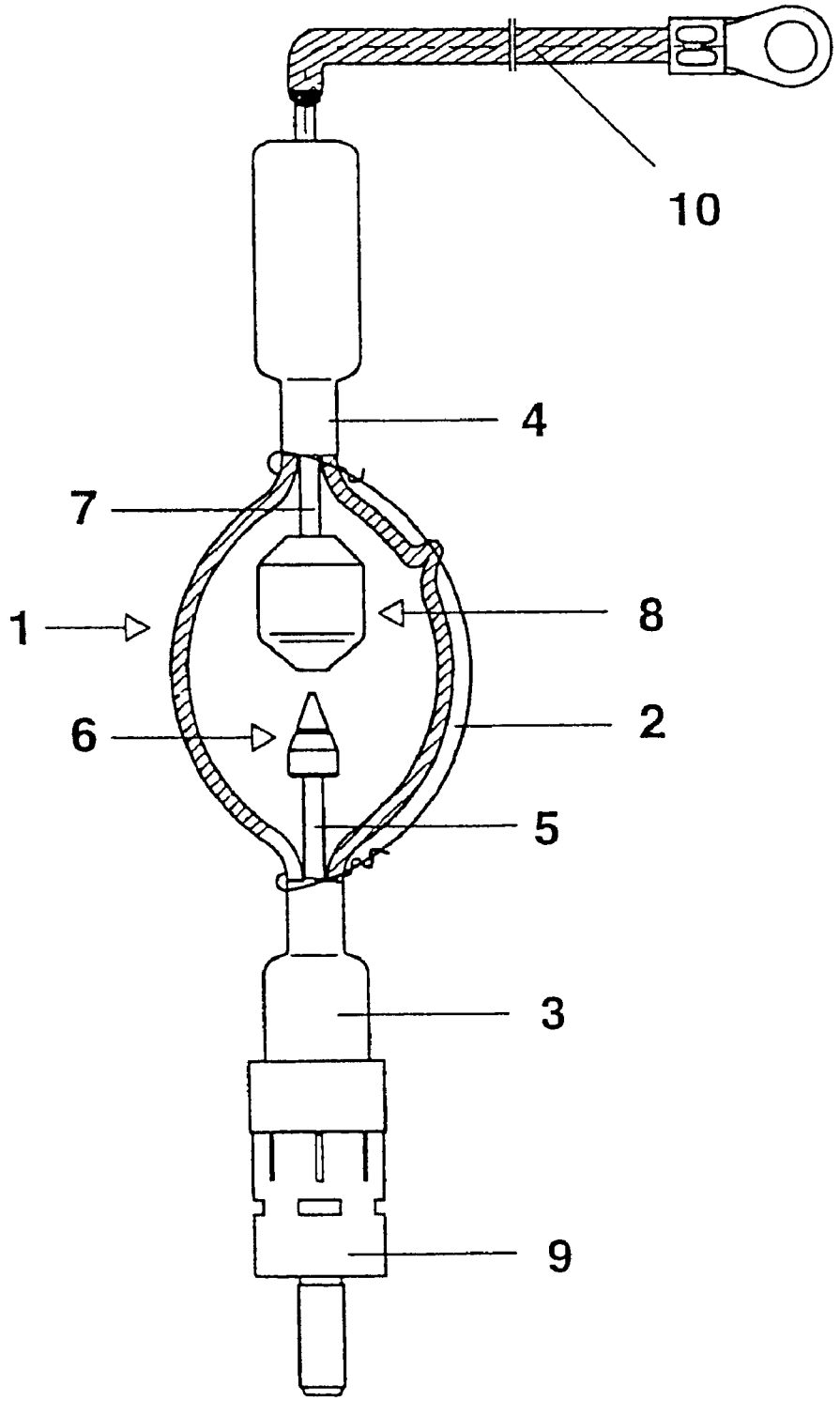
FIG. 1 shows a short-arc high-pressure discharge lamp according to the invention.
Figure 2:
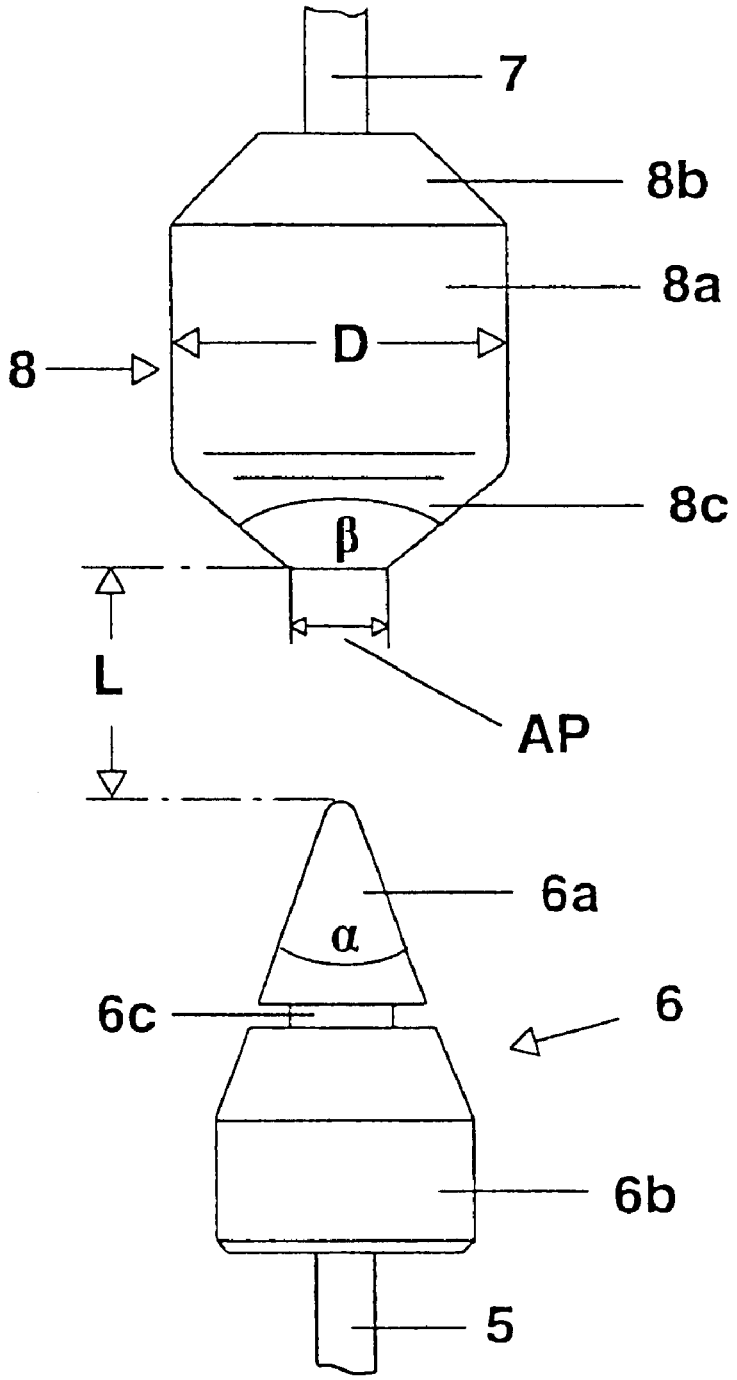
FIG. 2 shows, in an enlarged representation, the electrode arrangement of the short-arc high-pressure discharge lamp according to FIG. 1.

As can be seen in FIG. 2, the cathode 6 is composed of a conical end section 6*a*, which faces the anode 8, and an end section 6*b* which faces the electrode rod 5 and has a circular-cylindrical subsection as well as a frustoconical subsection, a section 6*c* of smaller diameter, which is likewise circular-cylindrical and is referred to as a heat damming groove being located between these two sections 6*a*, 6*b*. The tip of the conical end section 6*a*, which faces the anode 8 and has a vertex angle a of 40°, is designed as a hemisphere with a radius R of 0.6 mm.

The anode 8 consists of a circular-cylindrical middle section 8*a* with a diameter D of 22 mm and two frustoconical end sections 8*b*, 8*c*, which respectively face the cathode 6 and the electrode rod 7. The frustoconical end section 8*c* that faces the cathode 6 has a plateau AP with a diameter of 6 mm. All the sections of the two electrodes 6, 8 are made of tungsten.

The two electrodes 6, 7 are fitted opposite one another, in alignment with the axis of the lamp bulb 2, in such a way that the electrode separation, or arc length, is 3.5 mm when the lamp is hot.

When this lamp is used in a digital projection system, an improvement of up to 50% can be achieved compared with conventional short-arc high-pressure discharge lamps with a xenon fill.

What is claimed is:

1. A short-arc high-pressure discharge lamp (1) with a discharge vessel (2) which, besides a cathode (6) and an anode (8) that are situated opposite each other, contains a fill comprising at least xenon, wherein the cathode (6) has a conical end section (6*a*) facing the anode (8) and the anode (8) has a circular-cylindrical middle section (8*a*) and a frustoconical end section (8*c*) facing the cathode (6), characterized in that, for use in digital projection technologies, the high-pressure discharge lamp (1) has the following further features:

the separation L in mm of the two mutually facing end sections (6*a*, 8*c*) of the cathode (6) and the anode (8) when the lamp is hot is given by the relationship $$0.8\times P \leqq L \leqq 1\times P+1,$$

where P is the lamp power in kw the diameter D of the circular-cylindrical middle section (8*a*) of the anode (8) in mm is given by the relationship $$D \geqq 2.1\times L+10,$$

where L is the separation of the mutually facing end sections (6*a*, 8*c*) of the cathode (6) and the anode (8) in mm.

2. The short-arc high-pressure discharge lamp as claimed in claim 1, characterized in that the frustoconical end section (8*c*) of the anode (8), which faces the cathode (6), has a plateau AP with a diameter in mm that satisfies the relationship $$1.8\times L-1 \leqq AP \leqq 1.8\times L+1,$$

where L is the separation of the mutually facing end sections (6*a*, 8*c*) of the cathode (6) and the anode (8) in mm.

3. The short-arc high-pressure discharge lamp as claimed in claim 1, characterized in that the tip of the conical end section (6*a*) of the cathode (6) is designed as a hemisphere, wherein the radius R of the hemisphere in mm satisfies the relationship $$0.12\times P+0.1 \leqq R \leqq 0.12\times P+0.5,$$

with P being the lamp power in kW.

4. The short-arc high-pressure discharge lamp as claimed in claim 3, characterized in that the conical end section (6*a*) of the cathode (6) has a vertex angle $\alpha$ of between 36 and 44°.

5. The short-arc high-pressure discharge lamp as claimed in claim 1, characterized in that the frustoconical end section (8*a*) of the anode (8), which faces the cathode (6), has a vertex angle $\beta$ of between 90 and 105°.

6. A method of operating a short-arc high-pressure discharge lamp (1) as claimed in claim 1, characterized in that the short-arc high-pressure discharge lamp (1) is operated at a rated power P of between 0 and 5.5 kW, with a lamp current I in A of the relationship $$22\times P+38 \leqq I \leqq 22\times P+65$$

and at a rated power P of between 5.5 and 12 kW, with a lamp current I in A of the relationship $$10\times P+100 \leqq I \leqq 22\times P+65.$$

* * * * *